United States Patent [19]

Honkawa

[11] 4,117,316

[45] Sep. 26, 1978

[54] APPARATUS FOR CONTROLLING OPERATION CYCLE OF DUPLICATING MACHINE

[75] Inventor: Yoshinori Honkawa, Fuchu, Japan

[73] Assignee: Ryobi, Ltd., Fuchu, Japan

[21] Appl. No.: 806,433

[22] Filed: Jun. 14, 1977

[30] Foreign Application Priority Data

Jun. 14, 1976 [JP] Japan ..... 51-77828[U]

[51] Int. Cl.[2] ..... G06M 3/02; G06B 27/06

[52] U.S. Cl. ..... 235/92 SB; 235/92 CT; 235/92 PE; 235/92 R; 355/14

[58] Field of Search ..... 235/92 SB, 92 CT, 92 PE, 235/92 PD, 92 CC; 355/14; 101/113, 216

[56] References Cited

U.S. PATENT DOCUMENTS

| | | | |
|---|---|---|---|
| 3,413,452 | 11/1968 | Schlein | 235/92 CC |
| 3,445,639 | 5/1969 | Martens | 235/92 CT |
| 3,674,991 | 7/1972 | Isvetkou et al. | 235/92 PE |
| 3,750,603 | 8/1973 | Martin | 235/92 CT |
| 3,896,297 | 7/1975 | Ploppa | 235/92 PE |
| 3,917,396 | 11/1975 | Donohue et al. | 355/14 |
| 3,957,477 | 5/1976 | Jones et al. | 235/92 PE |

*Primary Examiner*—Joseph M. Thesz

*Attorney, Agent, or Firm*—Sughrue, Rothwell, Mion, Zinn and Macpeak

[57] ABSTRACT

Apparatus is disclosed for controlling the operation cycle of a duplicating machine. Each complete operation cycle of the duplicator includes plate loading, eching, inking, imaging, duplicating, blanket cleaning and plate removing processes. The number of revolutions of any cylinders constituting the duplicator and rotated synchronously with each other are counted by a counter. The counter starts and terminates its counting operation every time each of all the processes required for the duplicator is started and completed, in order to determine the period of time for carrying out each of the processes, thereby enabling always to maintain the best and uniform printing effect through a simpler and easier control than in a conventional duplicator.

5 Claims, 2 Drawing Figures

APPARATUS FOR CONTROLLING OPERATION CYCLE OF DUPLICATING MACHINE

BACKGROUND OF THE INVENTION

1. Field of the Invention

The present invention relates to an apparatus for automatically controlling the operation cycle of a duplicating machine, and more particularly to an apparatus capable of optionally and readily controlling the period of time for each of the process required for the duplicator including plate loading, eching, inking, imaging, duplicating, blanket cleaning and plate removing.

2. Description of the Prior Art

In conventional apparatus of this type, such processes required for a duplicator are controlled by means of a suitable cam mechanism or a timer. However, control by the cam mechanism has disadvantage that is is not only necessary to provide a plurality of different cams and their driving mechanism in order to determine the respective cam stroke lengths for carrying out all the processes of the duplicator, but it also requires a considerably large space for its installation. Additionally, when the kinds of plate to be printed and/or the number of revolutions of the duplicator is changed, different cam mechanisms are required or the quality of printing is otherwise degraded.

On the other hand, control by the timer has the drawbacks that it not only requires a comparatively intricate, troublesome and time consuming adjustment of the timer but also it is difficult to maintain the best and uniform printing effect, when the kinds of plate to be printed and/or the number of revolutions of the duplicator during the period of its one complete operation cycle is changed.

SUMMARY OF THE INVENTION

It is therefore an object of the invention to provide such a control apparatus capable of always maintaining the best and uniform printing effect through the simplest and easiest possible adjustment even if the kinds of plate to be printed and/or the number of revolution of the duplicator is changed.

DETAILED DESCRIPTION OF THE PREFERRED EMBODIMENT

Figure 1:
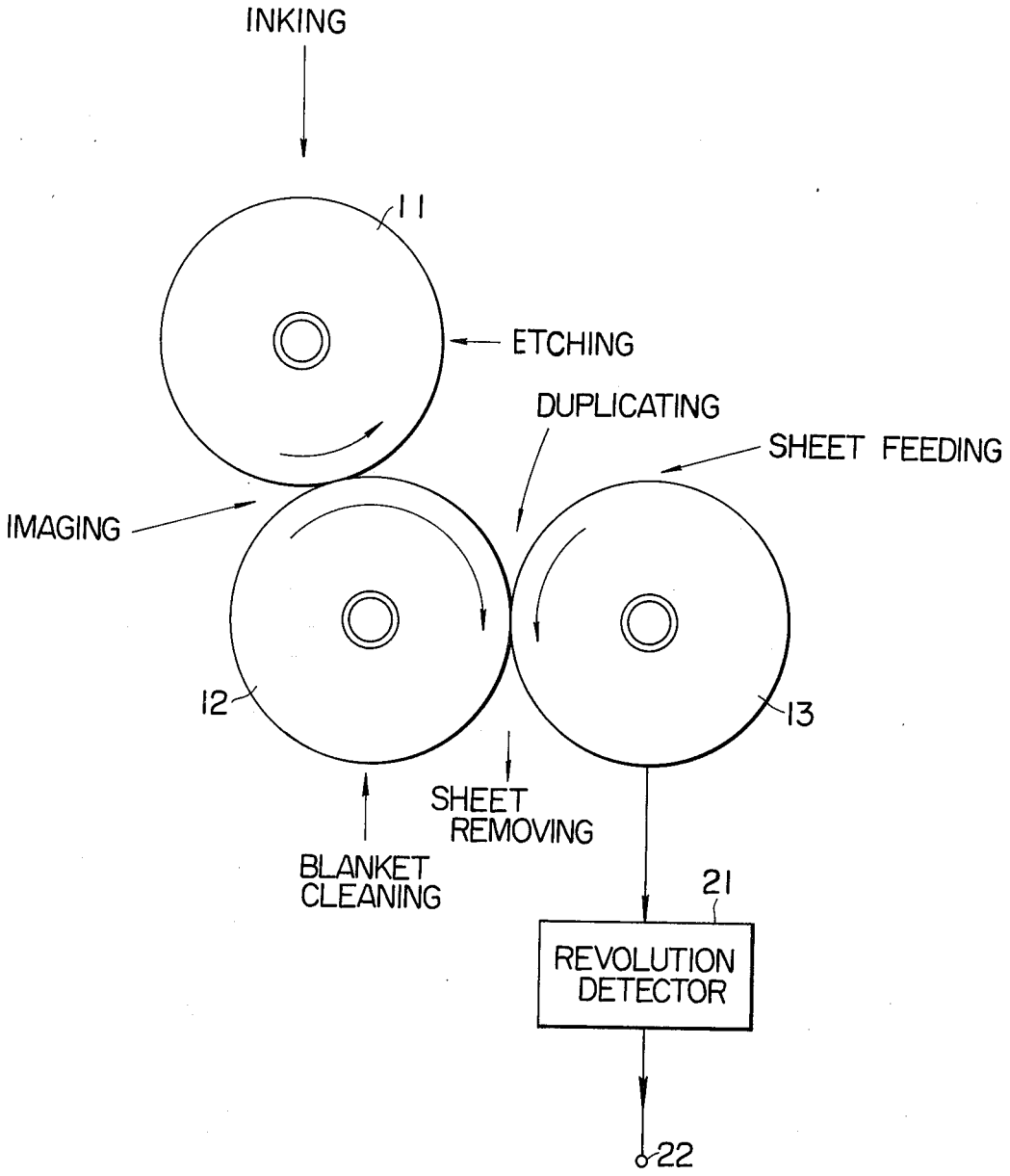
FIG. 1 shows a schematic principle construction of a rotary type offset duplicator.

As is well known to those skilled in the art, litho flat bed type and rotary type offset duplicators have been devised, but, nowadays, the former type duplicator is seldom used and the latter type duplicator as shown in FIG. 1 is mainly used. Namely, the rotary type offset duplicator generally comprises plate, blanket and impression cylinders 11, 12 and 13 rotated synchronously with each other in such directions as shown in FIG. 1.

The operation of the rotary type offset duplicator will be described hereinunder:

(1) Firstly, a flat metal plate being printed or duplicated is fastened or loaded on the periphery of the plate cylinder 11. Under this condition, etching and then inking processes are carried out in connection with the plate cylinder 11 while rotating it;

(2) The blanket cylinder 12 is so contacted with the plate cylinder 11 as to rotate synchronously therewith and an imaging process is accomplished between these cylinders 11 and 12;

(3) The impression cylinder 13 is so contacted with the blanket cylinder 12 as to rotate synchronously therewith and a duplicating process is conducted between these cylinders 12 and 13 while feeding a sheet to be duplicated on the periphery of the impression cylinder 13, immediately thereafter the printed or duplicated sheet being removed therefrom by means, e.g., of a flyer delivery (not shown); and (4) Finally, a blanket cleaning process on the blanket cylinder 12 and the printed plate removing process on the plate cylinder 11 are carried out.

Figure 2:
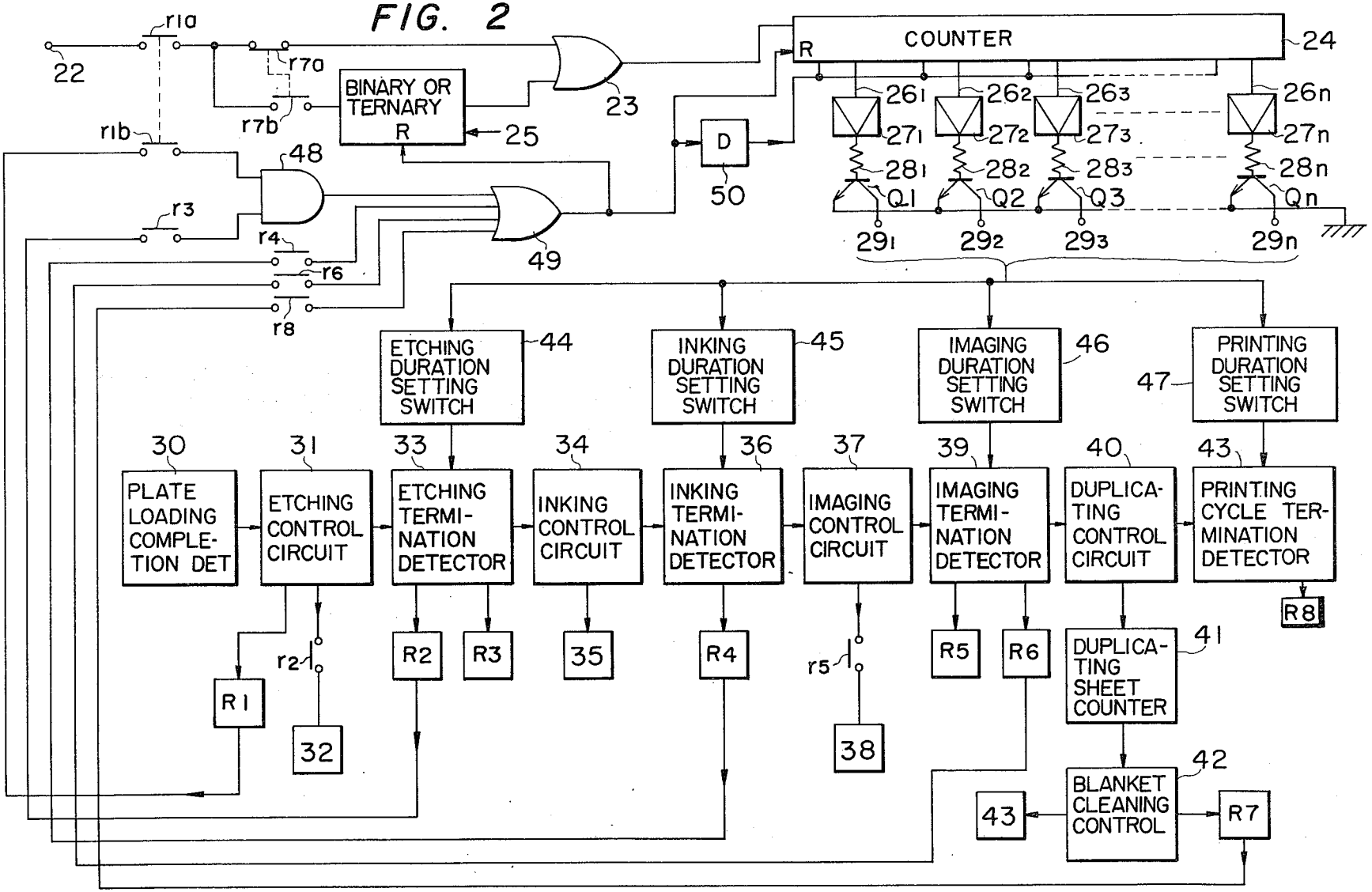
FIG. 2 shows a schematic block diagram of a control apparatus in accordance with the invention.

FIG. 2 shows a schematic block diagram of apparatus for automatically controlling all the above-mentioned processes required for the duplicator as shown in FIG. 1 in accordance with the invention.

Firstly, a revolution detector 21 is provided for counting the number of revolutions of any, e.g., the impression cylinder 13 of the three synchronously rotated cylinders 11 to 13 and delivering one output pulse per one complete revolution of the impression cylinder 13 on an output terminal 22. The output terminal 22 of the revolution detector 21 is connected via the hereinafter described self-holding type relay contact *r*1 and normally closed relay contact *r7a* to one input terminal of an AND gate 23 having its output terminal connected to an input terminal of a counter 24. The connection point between both the relay contacts *r1a* and *r7a* is connected via a normally open relay contact *r7b* actuated interlockingly with the relay contact *r7a* and a binary or ternary counter 25 to the other input terminal of the AND gate 23. The counter 24 is provided with a plurality of output terminals 261, 262, 264, . . . and 26*n* having binary weights or significances 1, 2, 4, . . . and *n*, respectively. The output terminals $26_1$ to $26_n$ of the counter 24 are connected via corresponding series circuits consisting of amplifiers $27_1$, $27_2$, $27_4$ . . . $27_n$ and resistors $28_1$, $28_2$, $28_4$, . . . $28_n$ to bases of corresponding emitter grounded transistors $Q_1$, $Q_2$, $Q_4$, . . . $Q_n$, respectively. The bases of the transistors $Q_1$ to $Q_n$ are so biased that the transistors are all normally kept nonconductive but, only one of them having its base connected so that of the output terminals $26_1$ to $26_n$ of the counter 24 from which deliver an output signal is rendered conductive, thereby delivering an output signal from the corresponding collector terminal $29_1$, $29_2$, $29_4$, . . . or $29_n$.

In FIG. 2, reference numeral 30 designates a plate loading completion detector having its output terminal connected to an input terminal of an etching control circuit 31. The etching control circuit 31 has one output terminal connected via a normally open relay contact *r*2 to an etching solenoid 32 and is provided with a relay R1 for simultaneously actuating the relay contacts *r1a* and *r*2. Connected to the other output terminal of the etching control circuit 31 is an etching termination detector 33 having a relay R2 for actuating the relay contact *r*2 and a reset relay R3 for actuating the hereinafter described normally open reset relay contact *r*3. Connected to the output terminal of the etching termination detector 33 is an inking control circuit 34 for controlling an inking solenoid 35 and connected to the output of the inking control circuit 34 is an inking termination detector 36 controlling a reset relay R4 for actuating the hereinafter described normally open reset relay contact *r*4.

Connected to the output terminal of the inking termination circuit 36 is an imaging control circuit 37 having one output terminal connected via a normally open relay contact *r*5 to a solenoid 38 for contacting the blanket cylinder 12 with the plate cylinder 11. Connected to the other output terminal of the image control circuit 37 is an imaging termination detector 39 providing a relay R5 for actuating the relay contact *r*5 and a reset relay R6 for actuating the hereinafter described normally open reset relay contact *r*6. Connected to the output terminal of the imaging termination detector 39 is a duplicating control circuit 40 coupled to a duplicating sheet counter 41 and in turn coupled to a blanket cleaning control circuit 42 controlling a blanket solenoid 43 and a relay R7 for actuating the aforesaid relay contacts *r7a* and *r7b*. The output terminal of the blanket cleaning control circuit 42 is connected to a printing cycle termination detector 43. The etching, inking, imaging and printing cycle termination detectors 33, 36, 39 and 43 are each coupled to the corresponding output terminal of etching, inking, imaging and printing duration setting switch circuits 44, 45, 46 and 47.

On the other hand, there is provided an AND gate 48 having one input terminal connected via a normally open relay contact *r1b* actuated interlocking with the relay contact *r1a* to the output terminal of the etching control circuit 31, and the other output terminal connected via the relay contact *r*3. The output terminal of the AND gate 48 is connected to a first input terminal of an OR gate 49, the OR gate 49 having a second input terminal connected via the relay contact *r*4 to the output terminal of the inking termination detector 36, a third input terminal connected via the relay contact *r*6 to the output terminal of the image termination detector 39, and a fourth input terminal connected via the relay contact *r*8 to the printing cycle termination detector 43. The output terminal of the OR gate 49 is connected to the reset terminal of the binary or ternary counter 25 and to the reset terminal of the counter 24. The reset terminal of the counter 24 is connected to its common clear terminal via a delay circuit 50 such as a D-type flip-flop circuit.

The operation of the circuitry shown in FIG. 2 will now be described with reference to FIG. 1.

Firstly, when a plate being printed is loaded on the plate cylinder 11, the etching control circuit 31 is made operative by an output signal from the plate loading completion detector 30, and the relay R1 is so actuated as to close the relay contacts *r1a* and *r*2 and energize the etching solenoid 32. Therefore, the etching process is accomplished in connection with the plate cylinder 11 and the number of output pulses from the revolution detector 21 is counted through the closed relay contact *r1a* and the OR gate 23 by the counter 24. When the number of counts of the counter 24 coincides with the preselected value of the etching duration setting switch circuit 44, the etching termination detector 33 is rendered so operative as to actuate the relay R2, whereby the relay contact *r*2 is opened to deenergize the etching soleniod 32 and terminate the etching process. At this time, the relay R3 is so actuated as to enable and AND gate 48 and reset the counter 24. Immediately thereafter the reset state of the counter 24 is released through the delay circuit 50, whereby the counter 24 prepares the next counting operation. At the same time, the inking control circuit 34 is made so operative by an output signal from the etching termination detector 33 that the inking soleniod 35 is energized thereby to start the inking process. Thus, when the number of counts of the counter 24 coincides with the preselected value of the inking duration setting circuit 45, the inking termination detector 36 is made so operative as to actuate the reset relay R4 for closing the reset relay contact *r*4, whereby the counter 24 is again reset through the OR gate 49 and immediately thereafter the reset of the counter 24 is cleared through the relay circuit 50 so that the counter 24 makes ready for the next counting operation. At this time, the imaging control circuit 37 is made so operative by an output signal from the inking termination detector 36 as to actuate the relay R5 for closing the relay contact *r5 and energizing the solenoid 38. Thus, the number of counts of the counter 24 coincides with the preselected value of the imaging duration setting switch circuit 46, the imaging termination detector 39 is made so operative as to open the relay contact r5* and deenergize the soleniod 38, thereby to complete the imaging process.

At this time, the relay R6 is energized to close the relay contact *r*6, whereby the counter 24 is reset through the OR gate 49 and immediately thereafter the reset of counter 24 is cleared in the above-mentioned manner so that the counter 24 prepares the next counting operation. The duplicating start control circuit 40 is made so operation by an output signal from the imaging termination detector 39 as to start the duplicating operation between the blanket and impression cylinders 12 and 13. The duplicating operation is terminated when sheets equal in number to those predetermined in the duplicating sheet counter 41 have duplicated. At this time, the blanket cleaning control circuit 42 is made so operative by an output signal from the sheet counter 41 that the relay R7 is energized to open the relay contact *r7a* and close the relay contact *r7b*. As a result, the counter 24 starts its counting operation under the control of output signals obtained through the binary or ternary counter 25, making the blanket cleaning duration longer than those of the other etching, inking and imaging durations.

Thus, when the printing termination detector 43 is made operative through the printing duration setting switch circuit 47 in the similar manner as in the etching, inking and imaging processes, then the relay R8 is so actuated as to close the relay contact *r*8 and reset the counters 24 and 25 through the OR gate 49. At this time, the relay contact *r7a* is reclosed, the relay contact *r7b* is reopened, and the plate loading completion detector 30 is reset, whereby one complete printing cycle necessary for the duplicator is completed.

As will be apparent from the above, the control apparatus of the invention enables always to maintain the best and uniform printing effect by only a simpler and easier adjustment than in the conventional control apparatus.

It will be understood to those skilled in the art that various modifications and variations are considered without departing from the technical concept of the present invention.

What is claimed is:

1. An apparatus for controlling the operation cycle of a duplicating machine, said machine including plate loading means, etching means, inking means, imaging means and duplicating means, each complete operation cycle of the duplicating machine including, in succession, plate loading, etching, inking, imaging, and duplicating processes, comprising:

a plate loading completion detector for providing an output signal at the termination of said plate loading process;

a revolution detector for providing output signals at a frequency corresponding to the operating speed of the apparatus;

a counter for receiving and counting the output signals from said revolution detector;

a plurality of adjustable termination means, each said termination means being set to the desired duration of a respective one of said etching, inking, imaging and duplicating processes and each providing termination signals at the termination of its respective process;

switch means responsive to the output signals from said termination mean detectors for resetting said counter at the termination of each process and for disabling the means for the terminated process;

etching, inking, imaging and duplicating control circuits responsive to the output signals from said plate loading completion detector, etching, inking and imaging termination detectors, respectively, for energizing said etching, inking, imaging and duplicating means; and a printing termination means for receiving the counter value and resetting said counter at the termination of each printing cycle.

2. An apparatus according to claim 1, wherein each said termination means comprises:

an adjustable switch for receiving the value in said counter and providing an output signal when said counter value corresponds to the desired duration of the process whose termination is to be detected; and a termination detector for providing said termination signals in response to the output signal from said adjustable switch.

3. An apparatus according to claim 1, further comprising a cleaning control means for performing a blanket cleaning process, said apparatus further comprising:

a duplicating counter for counting the number of sheets duplicated during said duplication process, and for providing a duplication output signal when a predetermined number of sheets have been counted;

a cleaning control means responsive to said duplication output signal for energizing said cleaning means; and means for intercepting the revolution detector output signals and for providing timing signals to said counter at a reduced rate to thereby increase the duration of the blanket cleaning process.

4. An apparatus according to claim 3, wherein said means for intercepting is a binary counter.

5. An apparatus according to claim 3, wherein said means for intercepting is a ternary counter.

* * * * *